US006679770B1

(12) United States Patent
Sugai et al.

(10) Patent No.: US 6,679,770 B1
(45) Date of Patent: Jan. 20, 2004

(54) COIN COUNTING AND SORTING DEVICE

(75) Inventors: Katsumi Sugai, Nagoya (JP); Nobuyuki Nakatani, Himeji (JP)

(73) Assignees: Sugai General Industries Ltd., Aichi-ken (JP); Wing Design Co., Prev., Hyougo-ken (JP)

( * ) Notice: Subject to any disclaimer, the term of this patent is extended or adjusted under 35 U.S.C. 154(b) by 166 days.

(21) Appl. No.: 10/069,060

(22) PCT Filed: Jun. 30, 2000

(86) PCT No.: PCT/JP00/04398

§ 371 (c)(1),
(2), (4) Date: Feb. 19, 2002

(87) PCT Pub. No.: WO01/15090

PCT Pub. Date: Mar. 1, 2001

(30) Foreign Application Priority Data

Aug. 20, 1999 (JP) ..... 11/234229

(51) Int. Cl.[7] ..... G07D 3/06
(52) U.S. Cl. ..... 453/10
(58) Field of Search ..... 199/344; 133/3 E; 453/10, 12, 17, 32, 57; G07D 3/06, 3/02, 3/16, 9/04, 9/00

(56) References Cited

U.S. PATENT DOCUMENTS

| | | | | |
|---|---|---|---|---|
| 4,437,478 A | | 3/1984 | Abe | |
| 4,586,522 A | | 5/1986 | Taipale et al. | |
| 4,598,724 A | * | 7/1986 | Boland | 453/32 |
| 5,286,226 A | | 2/1994 | Rasmussen | |
| 5,295,899 A | | 3/1994 | Adams et al. | |
| 5,366,407 A | | 11/1994 | Sentoku | |
| 5,564,978 A | * | 10/1996 | Jones et al. | 453/17 |
| 5,607,351 A | | 3/1997 | Schwartz | |
| 5,688,166 A | * | 11/1997 | Chen | 453/57 |
| 5,992,602 A | | 11/1999 | Zwieg et al. | |
| 6,030,284 A | | 2/2000 | Frank | |
| 6,379,239 B1 | * | 4/2002 | Sugai et al. | 453/32 |

FOREIGN PATENT DOCUMENTS

| | | |
|---|---|---|
| GB | 2 208 738 | 4/1989 |
| JP | 63-250792 | 10/1988 |
| JP | 3-17866 | 2/1991 |
| JP | 3-21170 | 3/1991 |
| JP | 5-298517 | 11/1993 |
| WO | 95/04978 | 2/1995 |

* cited by examiner

*Primary Examiner*—Donald P. Walsh
*Assistant Examiner*—Kenneth W. Bower
(74) *Attorney, Agent, or Firm*—Merchant & Gould P.C.

(57) ABSTRACT

A compact, simply structured token counting and sorting apparatus includes a rotary disc 10 which is rotatable by a handle 17. A generally arcuate token transfer track 23 including a token transfer inlet 24 is arranged along the outer circumference of the rotary disc 10. The token transfer track 23 is provided with a plurality of sorting holes 25 for successively sorting and dropping the tokens in the order of increasing diameters as the tokens are transferred from the upstream side toward the downstream side in the transfer direction. A transfer belt 30, which is annular as viewed in plan, is disposed above the outer circumference of the rotary disc 10 for rotation together with the rotary disc 10 to transfer the tokens while pressing the tokens against a surface of the token transfer track 23 A token discerner 31 is provided in the token transfer track 23 between the token transfer inlet 24 and the sorting hole 25 located at the most upstream position for determining the count and diameters of the tokens.

7 Claims, 13 Drawing Sheets

COIN COUNTING AND SORTING DEVICE

TECHNICAL FIELD

The present invention relates to a token counting and sorting apparatus to which unassorted tokens of different kinds (e.g. denominations), which may be coins as currency or coin-shaped medals used for various game machines, are supplied and which is capable of sorting the tokens based on the kinds (denominations) and counting and displaying the number of the sorted tokens for each kind (e.g. denomination) and the total number of the all kinds of tokens.

BACKGROUND ART

Token counting and sorting apparatuses of this kind are conventionally proposed. For example, JP-A-9-500468 discloses an apparatus comprising a rotary disc having an elastic upper surface, means for rotating the rotary disc, and a stationary sorting head in the form of an annular disc arranged in parallel to the upper surface of the rotary disc while being slightly spaced therefrom. An opening for supplying coins is provided at the central portion above the mount disc.

The lower surface of the stationary sorting head includes an alignment region for aligning respective radially outer peripheral edges of coins of all denominations at a common radial position, a plurality of exit passages for receiving coins of different diameters, respectively, and for guiding the coins to the respective exit openings arranged along the outer circumference of the sorting head, and a guide wall extending between at least a selected pair of the exit passages. The guide wall engages the radially outer peripheral edge of a coin, which cannot enter at least a first one of the two adjacent exit passages, for guiding and retaining the radially outer peripheral edge of the coin at the common radial position.

A drawback of the above-described structure resides in the difficulty of machining the alignment region, the exiting passages and the guide wall.

On the other hand, JP-A-63-250792 and JP-A-5-29517 disclose an apparatus which includes a rotary disc rotatable by a driving motor for carrying plural kinds of tokens supplied from a supplying section arranged above. The apparatus further includes a generally linear token discerning track which has an inlet for receiving tokens paid out from the rotary disc one by one and which has a down stream portion bent generally perpendicularly as viewed in plan, and a linear sorting track provided downstream from the token discerning track. A transfer belt which is straight as viewed in plan is disposed above each of the token discerning track and the token sorting track. The token discerning track is provided with a material sensor and a diameter sensor. The transfer belt transfers the tokens one by one while pressing the tokens against a guide member. The token sorting track is formed with a plurality of aligned sorting holes arranged at a predetermined pitch as viewed in plan. An edge portion of each sorting hole on the guide member side is spaced from the guide member by a predetermined amount. The distance between the guide member and the edge portion of the sorting hole on the side farther from the guide member increases correspondingly to the diameter of the token to be sorted at that hole as compared with a preceding sorting hole of the transfer direction. The tokens sorted are dropped into respective storage spaces provided correspondingly to the sorting holes.

However, the token counting and sorting apparatus having the above-described structure is disadvantageously large, because the apparatus includes the token discerning track extending generally tangentially to the outer circumference of the rotary disc, and the generally straight token sorting track connected generally perpendicularly to the curved downstream portion of the token discerning track. Moreover, the transfer belt, which is an endless belt, is disposed so that the lower side thereof is kept facing the upper surface of the token discerning track and the token sorting track. Therefore, the transfer belt rotates in a plane which is perpendicular to the token discerning track and the token sorting track. With this structure, a large space need be provided above the token discerning track and the token sorting track for the arrangement of the transfer belt, which makes the apparatus bulky.

Further, since two transfer belts need be driven, the driving mechanism therefor becomes complicated.

U.S. Pat. No. 5,922,602 discloses a further prior art apparatus wherein a rotary feed disc for tokens is disposed adjacent to a sorter plate which is generally circular as viewed in plan.

The sorter plate is formed with an arcuate outer circumferential rim having an end at which a pointed projection extends radially inwardly from the outer circumference of the upper surface of the rotary feed disc. The upper surface of the sorter plate is formed, at a position radially inwardly from the outer circumferential rim, with a sorting track in the form of a partially cut-away circle adjoining the outer circumferential edge of the rotating feed disc. The tokens on the rotary feed disc are arrested by the pointed projection and guided along the side surface thereof to slide along the outer circumferential rim to the sorting track. A rotary disc is disposed above the sorter plate to cover the sorting track. The rotary disc is provided, at the lower surface thereof, with inner and outer rows of projecting fingers formed of an elastic material such as a rubber. The tokens guided by the pointed projection are pressed by the fingers against the outer circumferential rim to move along the sorting track.

The sorting track is formed with a plurality of generally rectangular openings arranged in a row at a predetermined pitch radially inwardly from the outer circumferential rim. When the distance between the inner surface of the outer circumferential rim and the radially inner edge of each opening is smaller than the diameter of a token to be sorted, the token passes over the opening. Conversely, when that distance is larger than the diameter of the token, the token drops through the opening. In this way, tokens are sorted in accordance with the differences of the diameters. Therefore, the openings are arranged in the order of increasing width from the upstream side toward the downstream side in the transfer direction.

An induction coil for determining whether or not the tokens are proper ones and a trigger sensor for detecting the passing of the tokens are disposed downstream of the token transfer track relative to the base portion of the pointed projection and at the starting end of the sorting track. Further, at the starting end of the outer circumferential rim, a shaft having a notch is provided for rotation by an actuator. Further, the starting end of the sorting track is formed with a discharge hole for discharging improper tokens toward the upstream side in the transfer direction relative to the row of the openings. When the induction coil determines that a token is improper, the shaft pivots about the axis so that the side surface thereof projects radially inwardly from the inner surface of the outer circumferential rim, thereby deflecting and guiding the improper token toward the discharge hole.

This structure is also complicated and the apparatus becomes bulky, because the rotary feed disc and the sorter plate are arranged in side-by-side relationship. Therefore, the object of providing a compact apparatus cannot be accomplished with this structure.

SUMMARY OF THE INVENTION

It is therefore an object of the present invention to solve the above-described problems of the prior art apparatuses and to provide a compact token counting and sorting apparatus having a simple structure.

According to a first aspect of the present invention, there is provided an apparatus for counting and sorting different kinds of tokens comprising: a rotary disc having an upper surface for supporting the tokens, the disc being rotatable manually or by a driver; a generally arcuate token transfer track extending along an outer circumference of the rotary disc and including a token transfer inlet for receiving the tokens across the outer circumference of the rotary disc; a plurality of sorting holes formed in the token transfer track for successively sorting and dropping the tokens in an order of increasing diameters as the tokens are transferred from an upstream side toward an downstream side in a transfer direction; an annular transfer belt disposed above the outer circumference of the rotary disc for rotation together with the rotary disc to transfer the tokens while pressing the tokens against a surface of the token transfer track; a token discerner provided in the token transfer track between the token transfer inlet and the sorting hole located at the most upstream position in the transfer direction for counting the tokens while determining diameters of the tokens; a controller for calculating results obtained by the token discerner; and a display for displaying the calculated results which include the count of tokens for each kind and a total number of the tokens.

With this structure, an arcuate token transfer track for transferring tokens released to the transfer inlet is provided along the outer circumference of the rotary disc which carries unassorted tokens of different kinds, and a transfer belt rotates within a plane above the arcuate transfer track. Therefore, the apparatus of the present invention can be made smaller than a prior art apparatus both in plan view and in height. Moreover, since a single transfer belt is used, the driving mechanism therefor is simple.

According to a second aspect of the present invention, the token counting and sorting apparatus further comprises a reference guide plate providing an inner circumferential wall of the token transfer track and disposed outward of the outer circumference of the rotary disc. The reference guide plate is arranged so that the inner circumferential wall is close to the outer circumference of the rotary disc at a portion adjacent the token transfer inlet and gradually deviates away from the outer circumference of the rotary disc while approaching an inner circumference of the transfer belt between the token transfer inlet and the token discerner as the inner circumferential wall extends downstream in the transfer direction.

With this structure, each of the tokens released through the transfer inlet and captured by the transfer belt, which rotates in a plane and outwardly from the rotary disc, needs to travel only a short distance before the token comes into slidable contact with the reference guide plate. Further, the diameter of the token can be accurately determined at the token discerner.

According to a third aspect of the present invention, in the token counting and sorting apparatus, the transfer belt is disposed above the token transfer track. The transfer belt is arranged to be close to an outer circumferential wall of the token transfer track at a portion adjacent the token transfer inlet and gradually approach the reference guide plate as the transfer belt extends downstream in the transfer direction.

With this structure, the tokens can be successively captured by the transfer belt at the token transfer inlet. When the tokens captured are transferred along the token transfer track from the upstream side toward the downstream side, the tokens can be always pressed against the reference guide plate constituting the inner circumferential wall of the token transfer track. Therefore, each of the tokens can be positively and reliably dropped into the relevant sorting hole in the token transfer track depending on the diameter.

According to a fourth aspect of the present invention, in the token counting and sorting apparatus, the transfer belt has a lower surface formed with projecting fins which are elastically deformable for pressing the tokens toward an upper surface of the token transfer track.

With this structure, the token can be transferred along the transfer track with only the fin catching the token elastically deformed. The finned structure of the belt, in combination with the annular (ring-shaped) configuration of the transfer belt, contributes to a weight reduction of the apparatus.

According to a fifth aspect of the present invention, the token counting and sorting apparatus further comprises an auxiliary elastic member projecting downward between the outer circumference of the rotary disc and the inner circumference of the transfer belt for rotating together with the transfer belt for preventing stagnation of the tokens at a portion adjacent the token transfer inlet. With this structure, it is possible to prevent the tokens released from the rotary disc from stagnating (stalling) adjacent the token transfer inlet, thereby preventing the token jam.

According to a sixth aspect of the present invention, in the token counting and sorting apparatus, the rotary disc and the token transfer track are provided in a lower casing. The transfer belt is mounted to a rotary ring which is rotatably mounted to an upper casing capable of opening and closing movement relative to the lower casing. The upper casing is provided with a token feed opening radially inward from the rotary ring for feeding the tokens toward the rotary disc. The rotary ring is provided with a power transmission unit driven for rotation by a driving mechanism of the lower casing. With this structure, by opening the upper casing, the transfer belt together with the rotary ring can be easily separated from the token transfer track. Therefore, foreign matters entered the token transfer track can be easily removed. Further, the power transmission from the rotary disc to the rotary ring is enabled just by closing the upper casing relative to the lower casing.

According to a seventh aspect of the present invention, in the token counting and sorting apparatus, the lower surface of the transfer belt is formed with a multiplicity of projecting fins each of which is inclined toward the upstream side in the transfer direction as the fin extends downward.

Therefore, in capturing the token by the fin of the rotating transfer belt at around the token transfer inlet, the token can be easily introduced to under the fin. Further, when the token is thereafter transferred while being pressed against the upper surface of the token transfer track, the token can be kept in contact with the fin at a large contact area. Therefore, the deviation of the token from the transfer belt can be reduced.

According to an eighth aspect of the present invention, in the token counting and sorting apparatus, the token discerner comprises detection holes respectively arranged at positions for determining the diameters of the tokens, and photo sensors disposed separately from the detection holes and connected thereto via photo transmission cables.

With this structure, bulky components such as photo sensors need not be provided at the positions for determining the diameters of the tokens (detection holes). Therefore, minute-stepwise discernment of tokens can be accurately performed using only a relatively small area of the apparatus. Further, the manufacturing cost for the apparatus can be decreased.

According to a ninth aspect of the present invention, the token counting and sorting apparatus further comprises a storage box or a hopper releasably mounted below each of the sorting holes for collecting and storing the tokens sorted. The hopper is provided with a storage bag removably attached thereto. This structure facilitates the work for collecting the sorted tokens.

MODE FOR CARRYING OUT THE INVENTION

The present invention may be embodied in a variety of modified and alternative versions, though the drawings show particular (or optimum) examples of embodiments, which will be described below with reference to the drawings.

However, the present invention is not to be limited to these particular embodiments but should be regarded as including all modified and alternative modes contained within the spirit and scope of the present invention defined in the claims.

Figure 1:
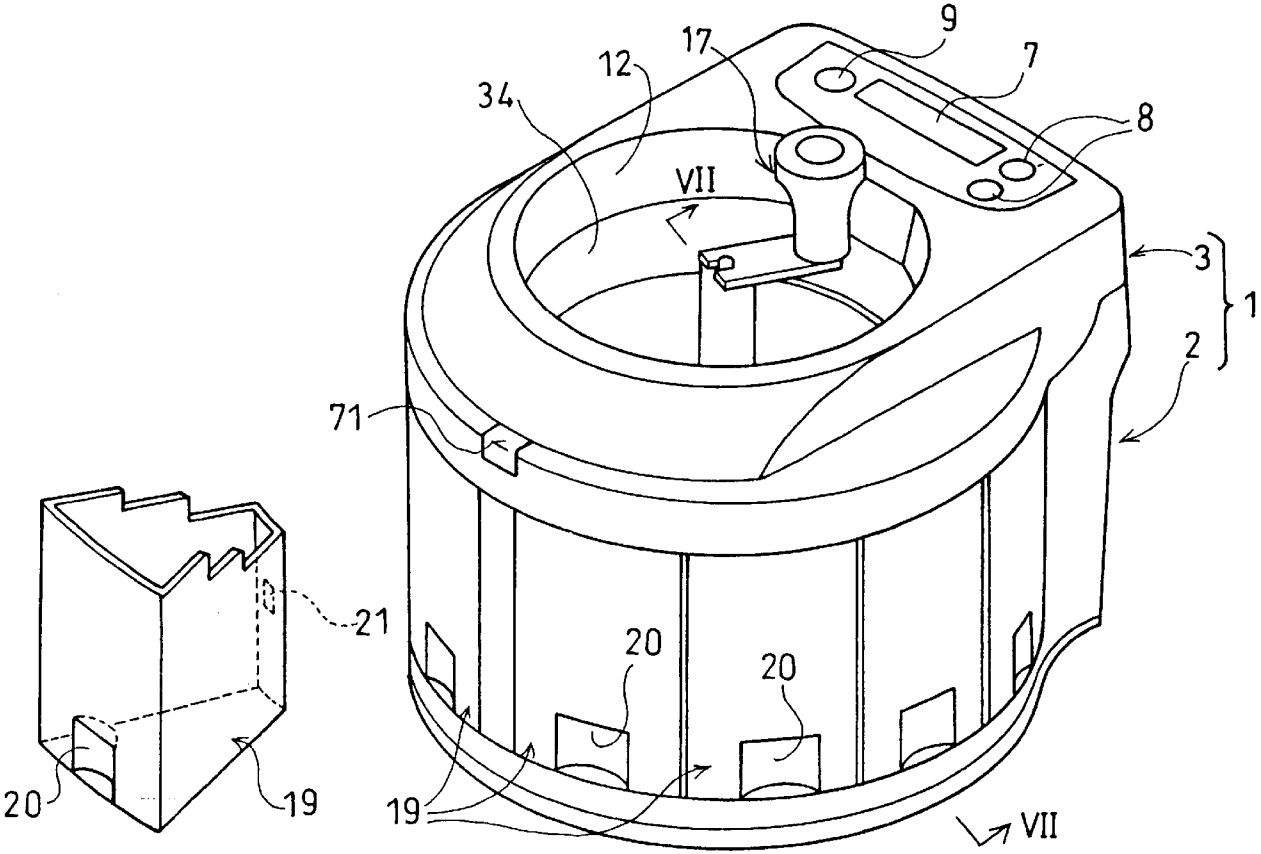
FIG. 1 is an overall perspective view showing a token counting and sorting apparatus.
Figure 2:
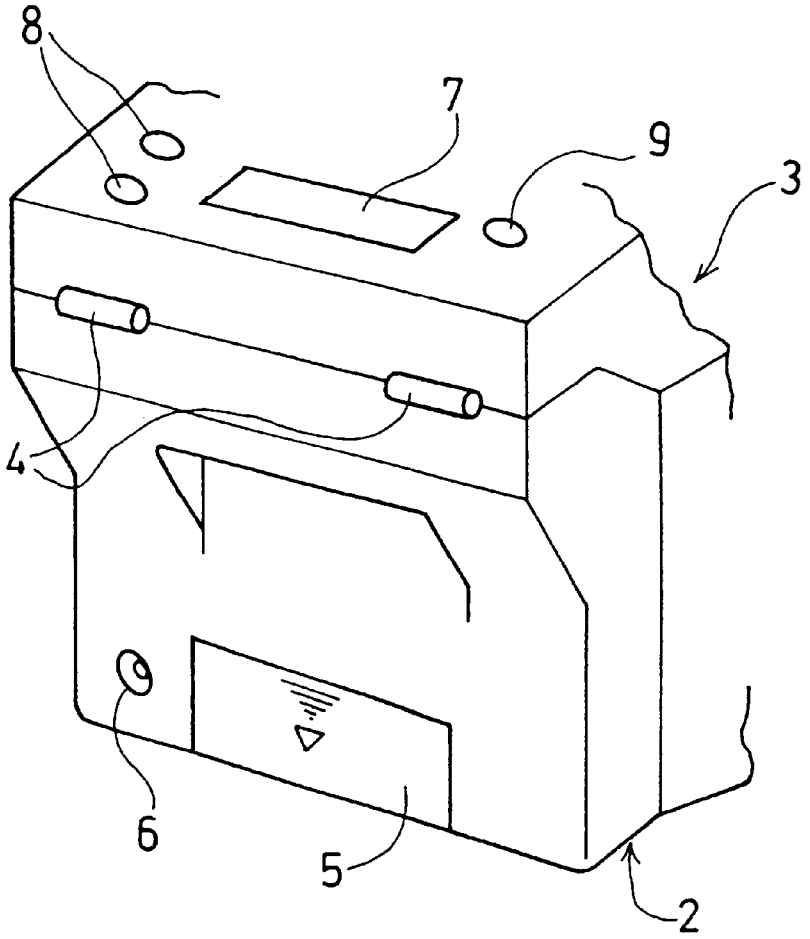
FIG. 2 is perspective view showing the rear portion of the token counting and sorting apparatus.
Figure 3:
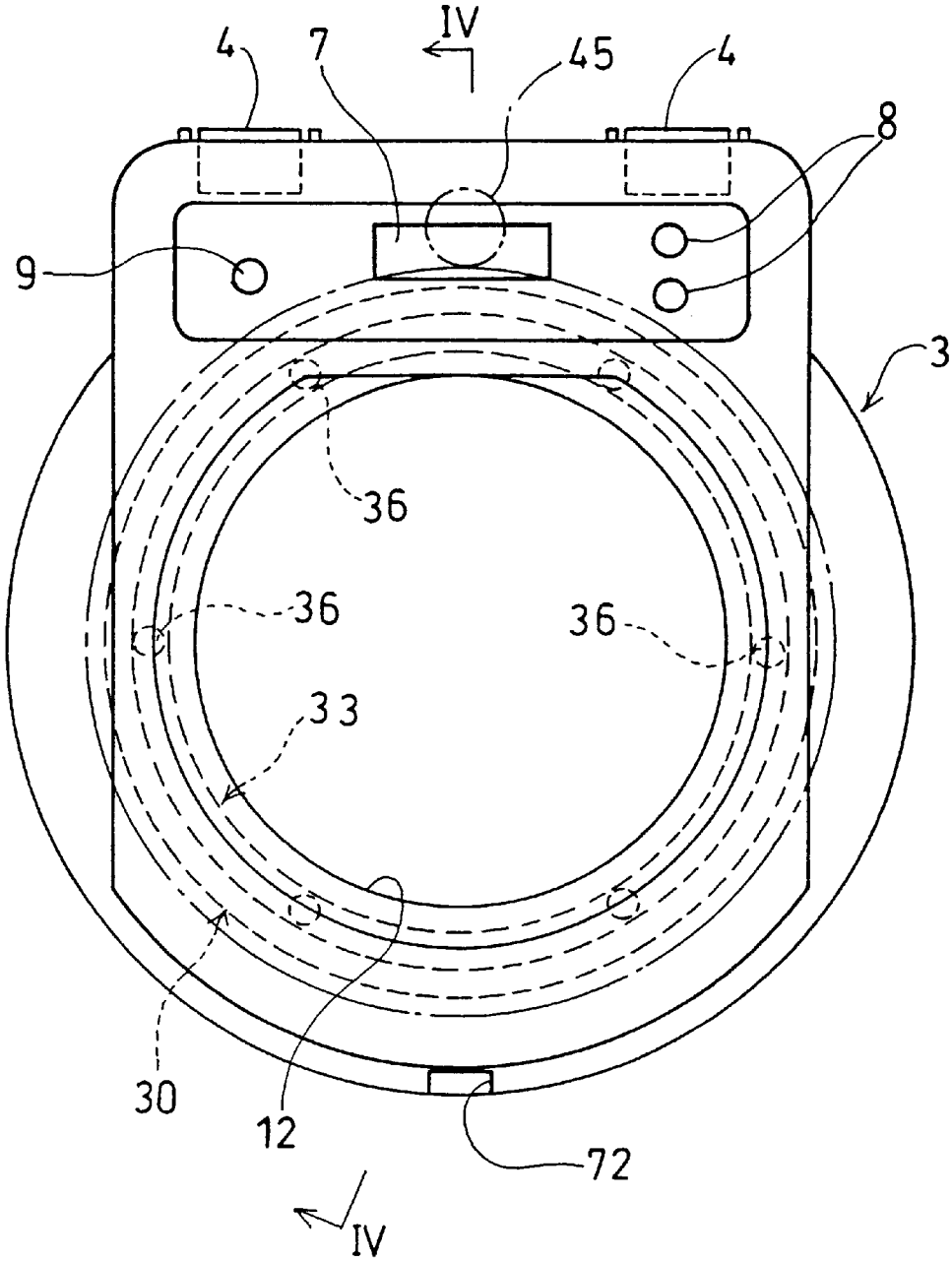
FIG. 3 is a plan view of the upper casing.
Figure 4:
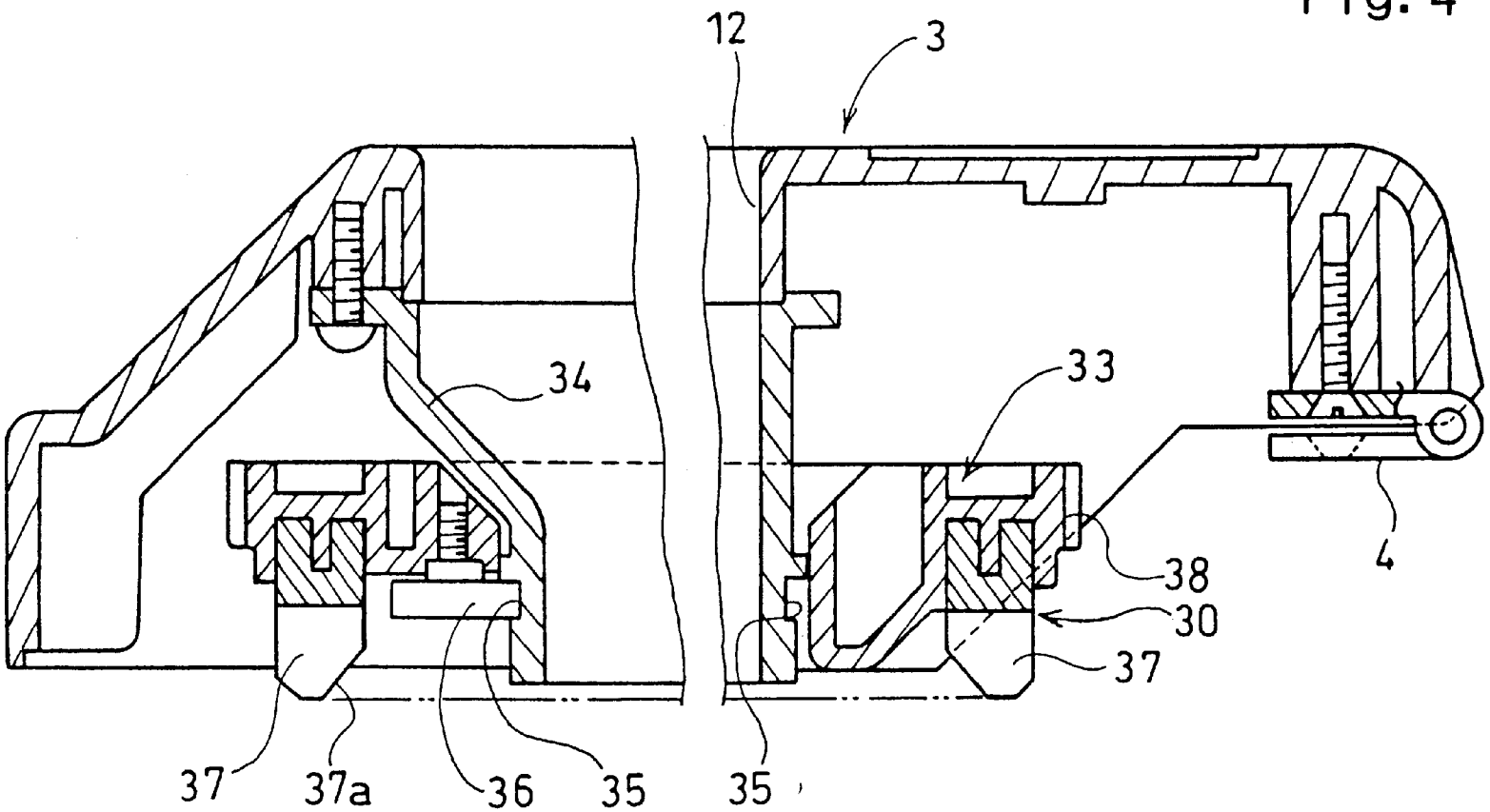
FIG. 4 is an enlarged sectional view taken on lines IV—IV in FIG. 3, which is partially cut away.
Figure 5:
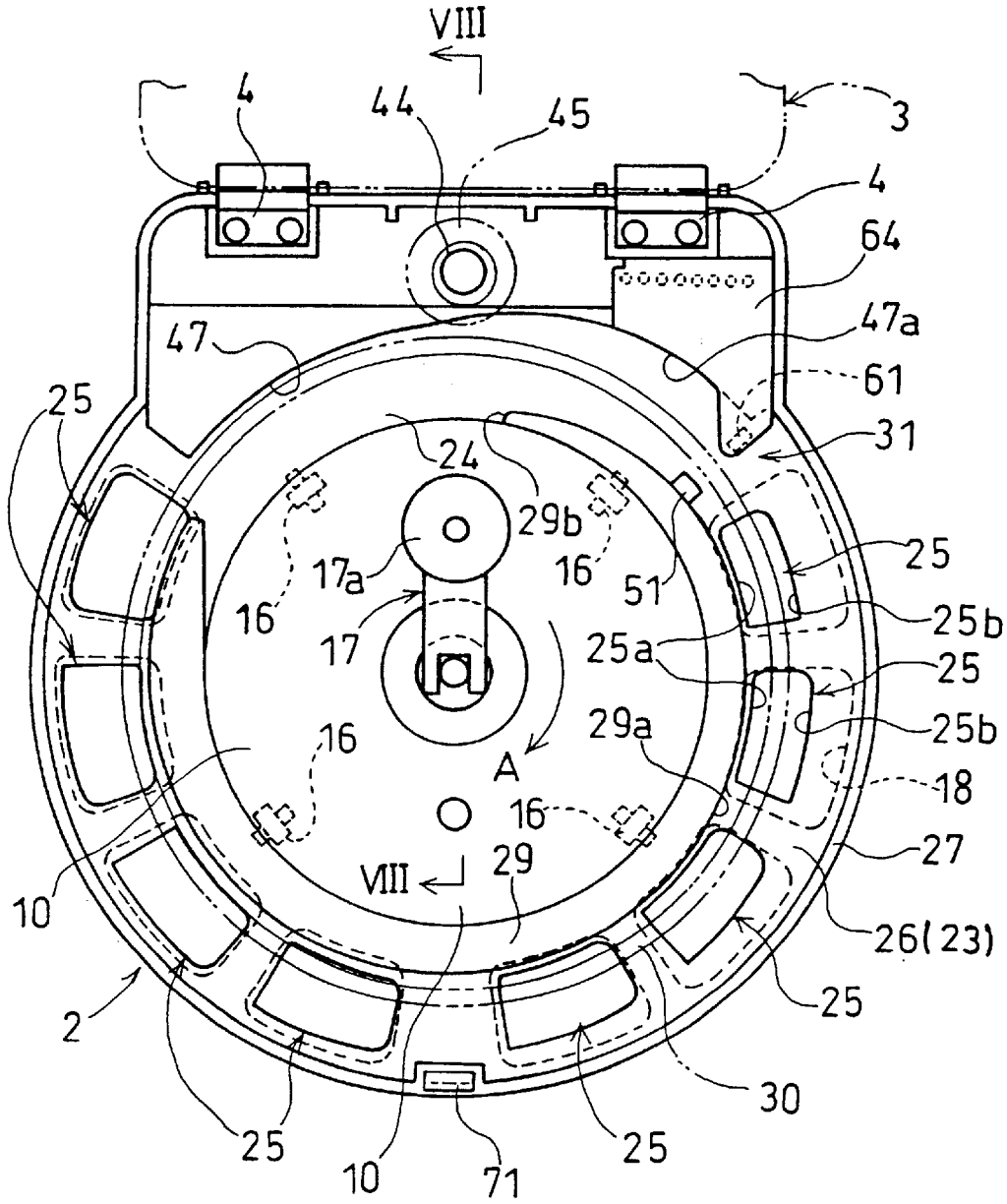
FIG. 5 is a plan view of the lower casing.
Figure 6:
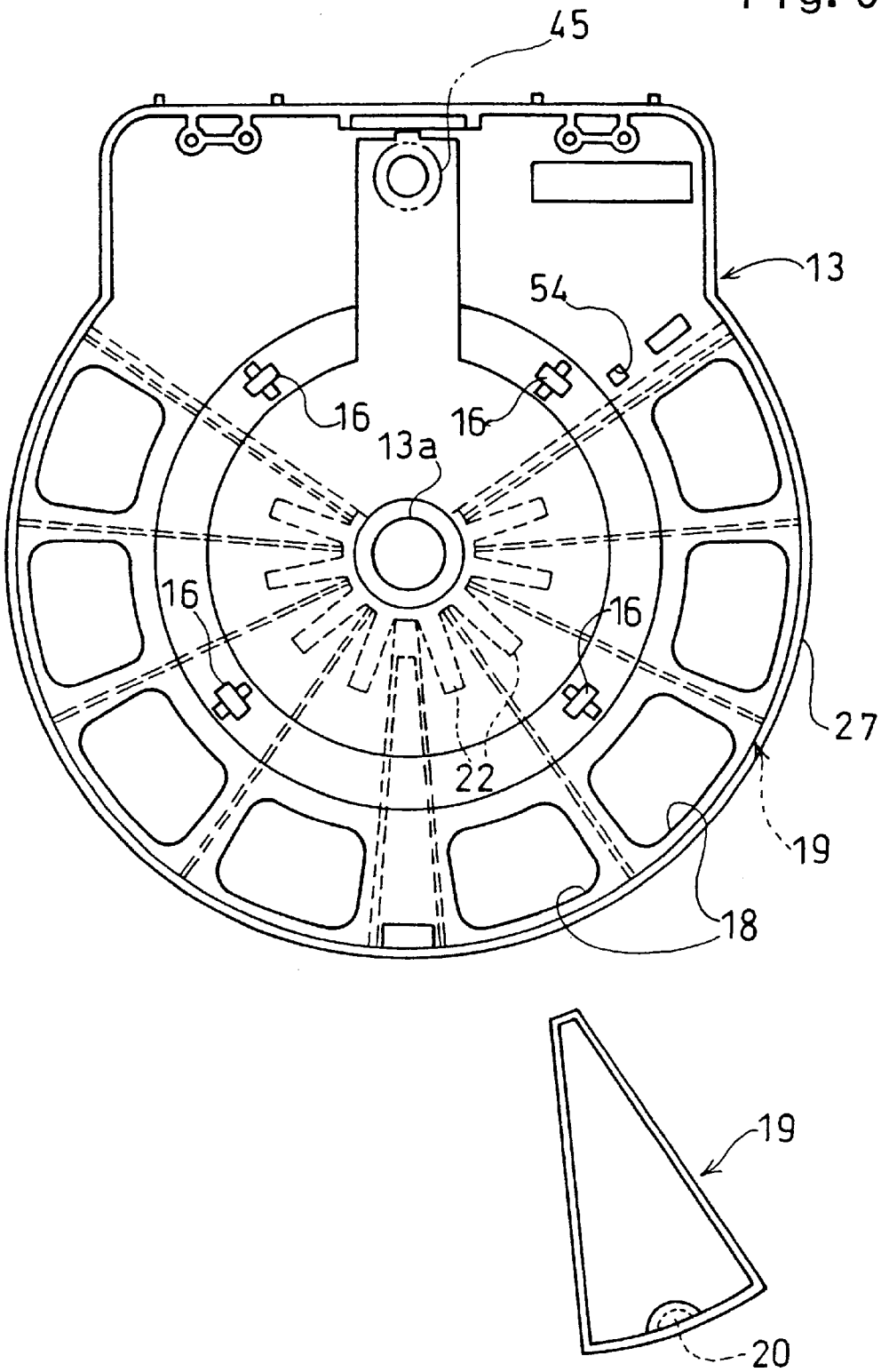
FIG. 6 is a plan view showing the upper partition plate and a storage box.
Figure 7:
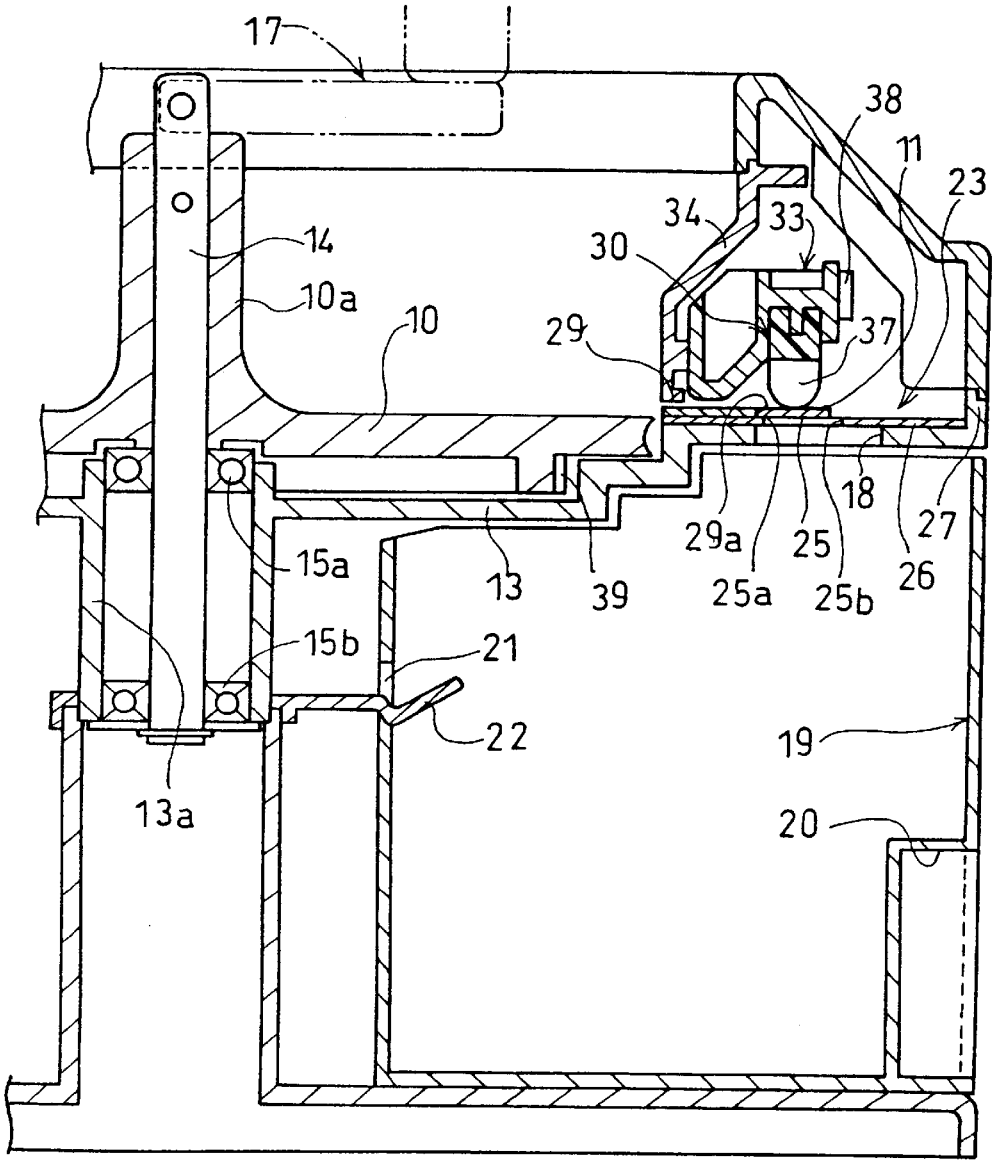
FIG. 7 is an enlarged sectional view taken on lines VII—VII in FIG. 1, which is partially cut away.

FIG. 1 is a perspective view showing a token counting and sorting apparatus. FIG. 2 is a perspective view showing a part of the apparatus as viewed from the rear side. FIG. 3 is a plan view of an upper casing. FIG. 4 is an enlarged sectional view of the upper casing, which is partially cut away. FIG. 5 is a plan view of a lower casing. FIG. 7 is an enlarged sectional view taken on lines VII—VII in FIG. 1.

As shown in FIGS. 1 through 7, the token counting and sorting apparatus 1 according to the present invention comprises a lower casing 2 and an upper casing 3 which are made of a synthetic resin and connected to each other by hinges 4 at their rear end portions for opening and closing movement. The upper casing 3 may be releasably attached to the lower casing 2.

As shown in FIG. 2, the lower casing 2 has a rear surface which is provided with a lid 5 for opening and closing a battery box for accommodating a portable battery such as a dry battery. The rear surface is further provided with a connector 6 for connection to an output of an AC adapter for converting commercial AC current to predetermined direct current. The upper casing 3 has an upper surface which is provided, at the rear portion thereof, with a display 7 for displaying, for example, the number and sum of tokens 11 for each kind as well as the total number and sum of all tokens 11 detected by token discerner, which will be described later. The upper surface of the upper casing is also provided with display switches 8 and a power switch 9 for example. The upper casing 3 is generally centrally formed with a token feed opening 12 which is generally equal in diameter to a rotary disc 10 and extends vertically through the upper casing for feeding the tokens 11 to the upper surface of the rotary disc 10, which will be described later.

In this embodiment, the tokens 11 to be counted and sorted may be EURO coins (unit: EURO) under European Monetary System including eight denominations, i.e. 0.01 EURO (diameter: 16.25 mm), 0.02 EURO (diameter: 18.75 mm), 0.05 EURO (diameter: 21.25 mm), 0.10 EURO (diameter: 19.75 mm), 0.20 EURO (diameter: 22.25 mm), 0.50 EURO (diameter: 24.25 mm), 1 EURO (diameter: 23.25 mm), and 2 EURO (25.75 mm). The tokens may be coins of the Japanese currency including six denominations i.e. 1-yen, 50-yen, 5-yen, 100-yen, 10-yen, and 500-yen in the order of increasing diameters. The tokens 11 may be circular metal pieces for use with game machines.

The token counting and sorting apparatus 1 according to the present invention includes the rotary disc 10 which has an upper surface for supporting the tokens 11 of different kinds or denominations (having different diameters) and which is rotatable manually or by a driver. The apparatus further includes a generally arcuate token transfer track 23 extending along the outer circumference of the rotary disc 10 and including a token transfer inlet 24 for receiving tokens across the outer circumference of the rotary disc 10. The token transfer track 23 is formed with a plurality of sorting holes 25 for successively sorting and dropping tokens 11 in the order of increasing diameters as the tokens 11 are transferred from the upstream side toward the downstream side in the transfer direction. Disposed above the outer circumference of the rotary disc 10 is a transfer belt 30 which rotates together with the rotary disc to transfer the tokens 11 while pressing the tokens against the token transfer track 23. In the token transfer track 23, a token discerner 31 for counting the tokens while determining diameters of the tokens is provided between the token transfer inlet 24 and the sorting hole 25 which is located at the most upstream position in the transfer direction. The apparatus further includes a controller 32 for calculating results obtained by the token discerner 31.

The results calculated by the controller 32, i.e. the count of tokens for each kind (denomination) and a total number of the tokens for example are displayed at the display 7.

Figure 8:
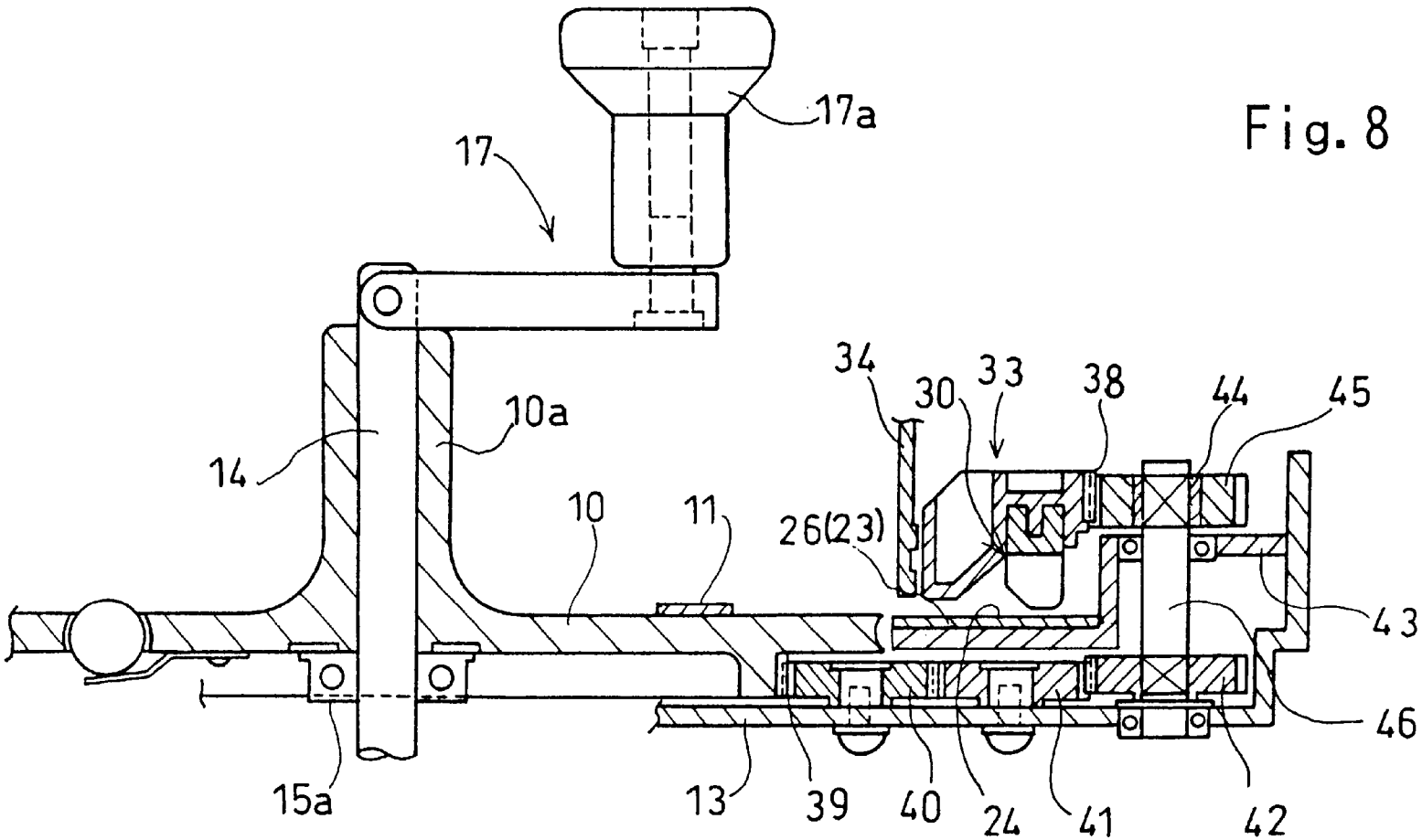
FIG. 8 is an enlarged sectional view taken on lines VIII—VIII in FIG. 5, which is partially cut away.

The rotary disc 10 in this embodiment is driven manually and the obverse (upper) surface thereof is centrally formed with an upwardly projecting boss 10*a* to which an upright shaft 14 is fitted. The shaft 14 has a lower portion rotatably supported by bearings 15*a*, 15*b* provided at a central cylinder 13*a* of an upper partition plate 13 defining the upper surface of the lower casing 2. The lower surface of the rotary disc 10 is supported, at the outer circumferential portion thereof, by a plurality of support rollers 16 provided at a stepped portion of the upper partition plate 13 for horizontal rotation of the disc. The shaft 14 has an upper end to which a handle 17 is pivotally connected via a pin. The handle 17 has a grip 17*a* which can be oriented to project upward (as shown in FIGS. 1 and 8) for manual rotation by the operator. The grip 17*a* can be folded downward for decreasing the overall height of the apparatus when the apparatus is not used.

The upper partition plate 13 of the lower casing 2 is formed with large through-holes 18 (eight holes in this embodiment) which are generally rectangular and circumferentially arranged as spaced from each other. A storage box 19 which is formed of a synthetic resin for example and is generally triangular as viewed in plan is removably attached to the lower casing 2 below each of the through-holes 18 for collecting and storing tokens dropped through the through-hole. The storage box 19 is formed, at the outer circumferential surface thereof, with an engagement recess 20 for engagement with an operator's finger. Further, the storage box 19 is formed, at the radially inner side thereof, with an engagement hole 21 for engagement with a corresponding one of engagement hooks 22 projecting radially outward from the central cylinder 13*a* of the lower casing 2 or the upper partition plate 13. Thus, the storage box 19 is prevented from unintentionally detached to project outward of the lower casing 2.

The upper partition plate 13 is upwardly provided with the generally arcuate token transfer track 23 arranged along the outer circumference of the rotary disc 10 and including the transfer inlet 24 (See FIG. 5) for receiving tokens across the outer circumference of the rotary disc 10, as well as the plurality of sorting holes 25 for successively sorting and dropping tokens 11 in the order of increasing diameters as the tokens 11 are transferred from the upstream side toward the downstream side in the transfer direction. (In this embodiment, eight sorting holes for sorting EURO coins of eight denominations are exemplarily illustrated.)

In this embodiment, the sorting holes 25, which are generally rectangular as viewed in plan, are formed in an abrasion-resistant plate 26 made of e.g. an abrasion-resistant metal and constituting the bottom of the token transfer track 23. The upper partition plate 13 is formed with a generally arcuate upwardly projecting rib 27 constituting the outer circumferential wall of the token transfer track 23. The inner circumferential wall of the token transfer track 23 is defined by an outer edge 29*a* of a reference guide plate 29 which is generally arcuate and attached to the upper surface of the abrasion-resistant plate 26 outwardly of the outer circumference of the rotary disc 10 by crimping or screwing.

The reference guide plate 29 has a thickness which is slightly smaller than the minimum thickness of the tokens 11 to be sorted and specifically 1 mm in this embodiment. The outer edge 29*a* of the reference guide plate 29 (which corresponds to the inner circumferential wall of the token transfer track 23) is close to the outer circumference of the rotary disc 10 at a portion adjacent the token transfer inlet 24 and gradually deviates away (farther) from the outer circumference of the rotary disc 10 as it extends downstream in the transfer direction.

Each of the sorting holes 25 has an inner side 25*a* and an outer side 25*b* which extend in parallel with the outer edge 29*a* of the reference guide plate 29. The distance between the outer edge 29*a* of the reference guide plate 29 and the outer side 25*b* of each sorting hole 25 is roughly equal to the diameter of the token 11 to be sorted at that hole. [Note that this does not hold for the last sorting hole (located at the most downstream position).] Further, the distance between the outer edge 29*a* of the reference guide plate 29 and the inner side 25*a* is about 1 mm for supporting and transferring the token 11 with its circumferential edge held in slidable contact with the outer edge 29*a*. The distance between the outer edge 29*a* of the reference guide plate 29 and the outer side 25*b* of each subsequent sorting hole 25 progressively increases. For example, the distance between the outer edge 29*a* of the reference guide plate 29 and the outer side 25*b* of the sorting hole 25 located at the most upstream position is slightly larger than the diameter of 0.01 EURO coins having the smallest diameter but slightly smaller than the diameters of other larger EURO coins. Thus, among the coins (tokens 11) being transferred while sliding along the outer edge 29*a* of the reference guide plate 29, only 0.01 EURO coins drop into the sorting hole 25 located at the most upstream position while other larger coins (tokens 11) pass over that sorting hole 25.

In this way, the eight denominations of EURO coins, i.e. 0.01 EURO coins, 0.02 EURO coins, 0.10 EURO coins, 0.05 EURO coins, 0.20 EURO coins, 1 EURO coins, 0.50 EURO coins, 2 EURO coins successively drop into respective sorting holes 25 arranged from the upstream side toward downstream side in the transfer direction. Thus, the tokens can be sorted so that each storage box 19 arranged at a respective sorting location can collect a single kind of tokens.

Tokens 11 having the largest diameter drop through the sorting hole 25 of the last position (located at the most downstream position) for storage in the relevant storage box 19 so that the tokens 11 can be prevented from being transferred beyond the sorting hole 25 of the last position (located at the most downstream position).

The ring-shaped (annular) transfer belt 30 is rotatably arranged on the lower side of the upper casing 3 and above the outer circumference of the rotary disc 10. The transfer belt 30 rotates together with the rotary disc 10 to transfer the tokens 11 downstream in the transfer direction while pressing, at the lower surface thereof, the tokens 11 against the upper surface of the abrasion-resistant plate 26 serving as the token transfer track 23. Specifically, as shown in FIGS. 3 through 5, a rotary ring 33 made of a synthetic resin is radially inwardly provided with a plurality of horizontal bearings 36 (six bearings in this embodiment). The horizontal bearings 36 slidably contact a ring-shaped rail 35 as a groove formed at the outer surface of a tube 34 made of a synthetic resin and constituting a lower part of the token feed opening 12 of the upper casing, thereby supporting the rotary ring 33 rotatably while also preventing unexpected detachment thereof.

Figure 9:
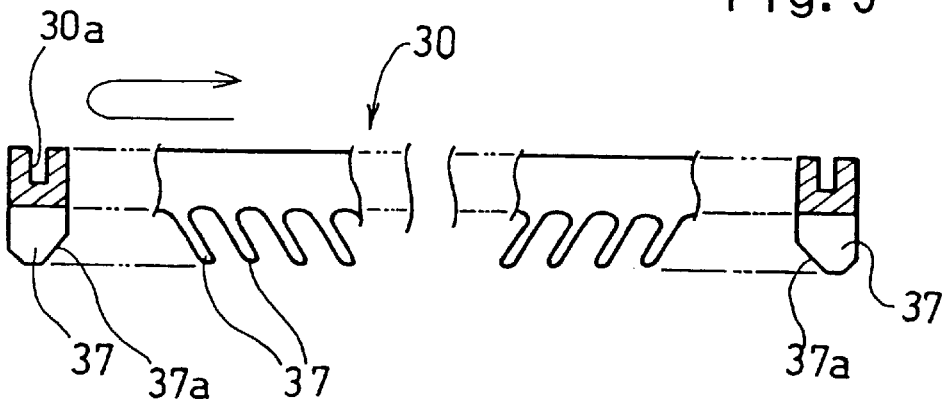
FIG. 9 is a sectional view showing the transfer belt.
Figure 10:
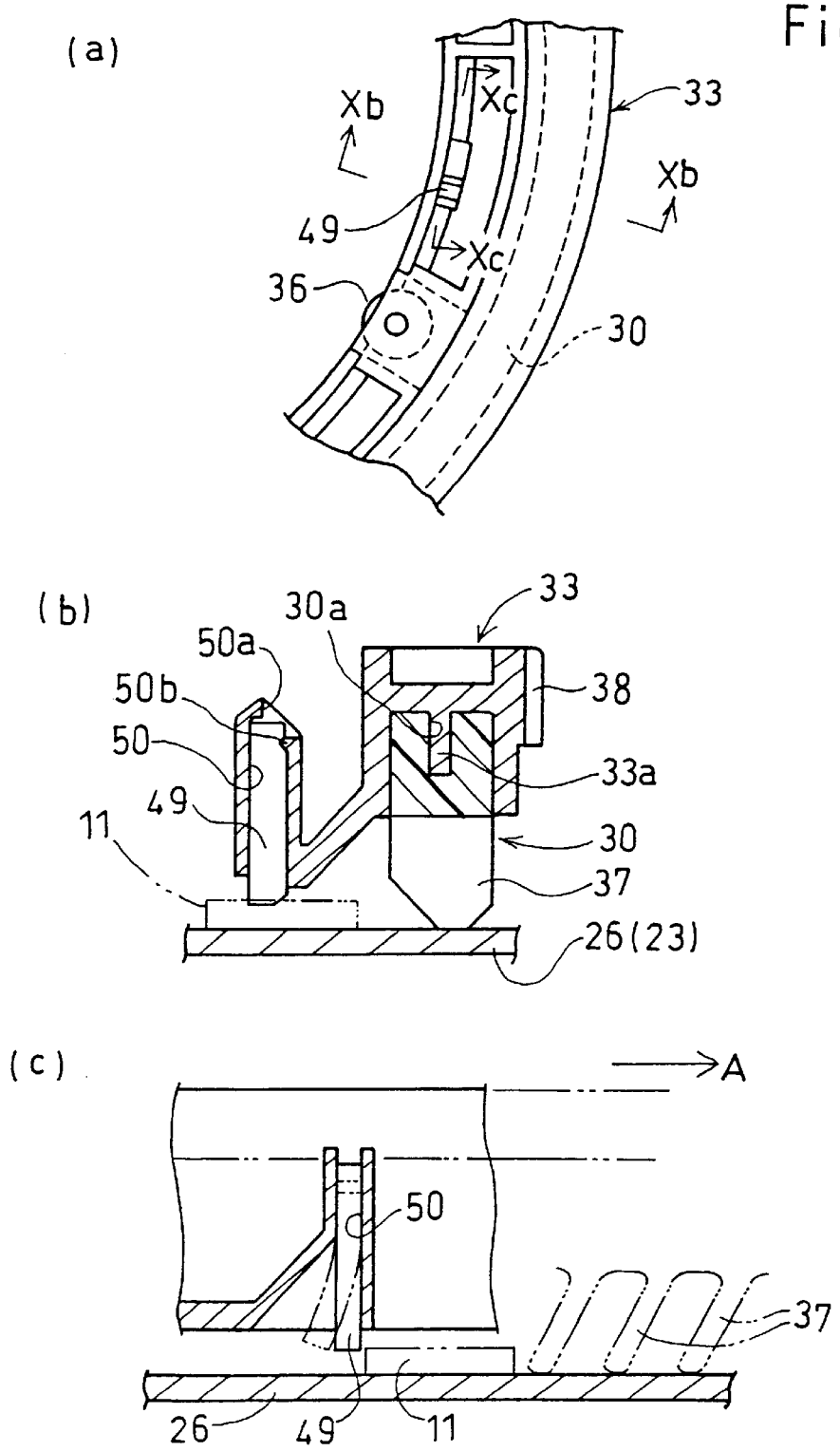
FIG. 10(*a*) is a plan view showing a part of the rotary ring, FIG. 10(*b*) is an enlarged sectional view taken on lines Xb—Xb in FIG. 10(*a*), and FIG. 10(*c*) is an enlarged sectional view taken on lines Xc—Xc in FIG. 10(*a*).

The ring-shaped transfer belt 30 (endless belt) is upwardly formed with a ring-shaped fitting groove 30*a* into which a ring-shaped engagement projection 33*a* formed at the lower surface of the rotary ring 33 is elastically fitted so as not to be unexpectedly detached (See FIGS. 4 and 10(*b*)). Further, the transfer belt 30 is formed, at the lower surface thereof, with a multiplicity of elastic fins 37 projecting downward and circumferentially spaced from each other at a predetermined pitch. As shown in FIG. 9, each of the fins 37 is inclined toward the upstream side in the token transfer direction as the fin extends downward. FIG. 9 illustrates the transfer belt 30 rotating clockwise. The left half of FIG. 9 illustrates the transfer belt 30 as viewed from the outer circumferential side, whereas the right half of FIG. 9 illustrates the transfer belt 30 as viewed from the inner circumferential side.

When there are no tokens 11 on the token transfer track 23 (abrasion-resistant plate 26), the lower end of each fin 37 does not slidably contact the abrasion-resistant plate 26 nor the reference guide plate 29 though held extremely close to the abrasion-resistant plate 26. On the other hand, when there exist tokens 11 on the token transfer track 23 (abrasion-resistant plate 26), the lower end of the fin 37 elastically deforms to move the tokens 11 downstream in the transfer direction while pressing the tokens against the abrasion-resistant plate 26.

The radially inward lower corner of each fin 37 of the transfer belt 30 is rounded or in the form of a cutting 37*a* for smoothly introducing tokens 11, which are released from the rotary disc 10 to the token transfer inlet 24, to between the fin and the abrasion-resistant plate 26.

A first intermediate gear 40 for meshing with gear teeth 39 of the outer circumference of the rotary disc 10, and a second intermediate gear 41 for meshing with the first intermediate gear are supported by the upper partition plate 13 to be rotatable about respective shafts. A third intermediate gear 42 for meshing with the second intermediate gear 41 has a shaft 46 which projects upward through a cover 43 covering the upper surface of the upper partition plate 13. The shaft 46 is provided, at the portion above the cover 32, with a transmission gear 45 attached thereto via a one way clutch 44. The transmission gear 45 meshes with gear teeth 38 formed at the outer circumference of the rotary ring 33. Thus, the rotary disc 10 is driven for rotation together with the rotary ring 33, i.e., the transfer belt 30. The above-described parts starting from the gear 40 to the transmission gear 45 constitute a driving mechanism. The teeth 38 provided at the outer circumference of the rotary ring 33 constitute a power transmission unit.

Referring to FIG. 5, when the handle 17 is rotated clockwise to rotate the rotary disc 10 in the arrow A direction (clockwise), the transfer belt 30 rotates in the same direction. At this time, the circumferential speed of the transfer belt 30 is preferably equal to or slightly lower than that of the outer circumference of the rotary disc 10. When the circumferential speed of the transfer belt 30 is excessively high, a great centrifugal force is exerted on the tokens 11 carried by the transfer belt 30. As a result, the tokens 11 to be transferred are likely to deviate away from the outer edge 29*a* of the reference guide plate 29, which may increase sorting errors.

When the tokens 11 jam at a portion adjacent the token transfer inlet 24 for example, the handle 17 is rotated counterclockwise. At this time, the transfer belt 30 is kept stationary due to the operation of the one way clutch 44.

As shown in FIG. 5, the outer edge 29*a* of the reference guide plate 29, which constitutes the inner circumferential wall of the token transfer track 23, is close to the outer circumference of the rotary disc 10 at a portion adjacent the token transfer inlet 24 and gradually deviates away from the outer circumference of the rotary disc 10 as it extends toward the downstream side. Specifically, the reference guide plate 29 is configured to bulge as viewed in plan between the token transfer inlet 24 and the token discerner 31 so that the outer edge 29*a* comes close to the inner circumference of the transfer belt 30.

On the other hand, the ring-shaped transfer belt 30, which is disposed above the token transfer track 23, is close to the outer circumferential wall 47 of the token transfer track 23 at a portion adjacent the token transfer inlet 24 and comes close to the outer edge 29*a* of the reference guide plate 29 as it extends toward the downstream side in the transfer direction.

Therefore, referring to FIG. 5, when each of the tokens 11 on the rotary disc 10 rotating clockwise is released to the token transfer inlet 24 due to the centrifugal force, the token 11 is caught by the radially inward lower end of the fin 37 of the transfer belt 30 rotating together with the rotary disc. As the transfer belt 30 rotates, the token 11 is transferred by rotating together with the fin 37. At this time, the fin 37 presses the token 11 against the upper surface of the abrasion-resistant plate 26 (token transfer track 23) while elastically deforming so that the lower end of the fin is inclined by a larger amount toward the upstream side in the transfer direction.

Before each of the tokens 11 transferred downstream reaches the token discerner 31, the outer edge of the token 11 is pressed against and slides along the outer edge 29*a* of the reference guide plate 29. Therefore, by setting detection positions as will be described later, the diameter of the token 11 can be accurately determined at the token discerner 31 by referring to the distance from the outer edge 29*a*.

Although the transfer belt 30 and the rotary disc 10 are concentrically arranged in the illustrated embodiment, the transfer belt 30 may be arranged eccentrically relative to the rotary disc 10.

Figure 11:
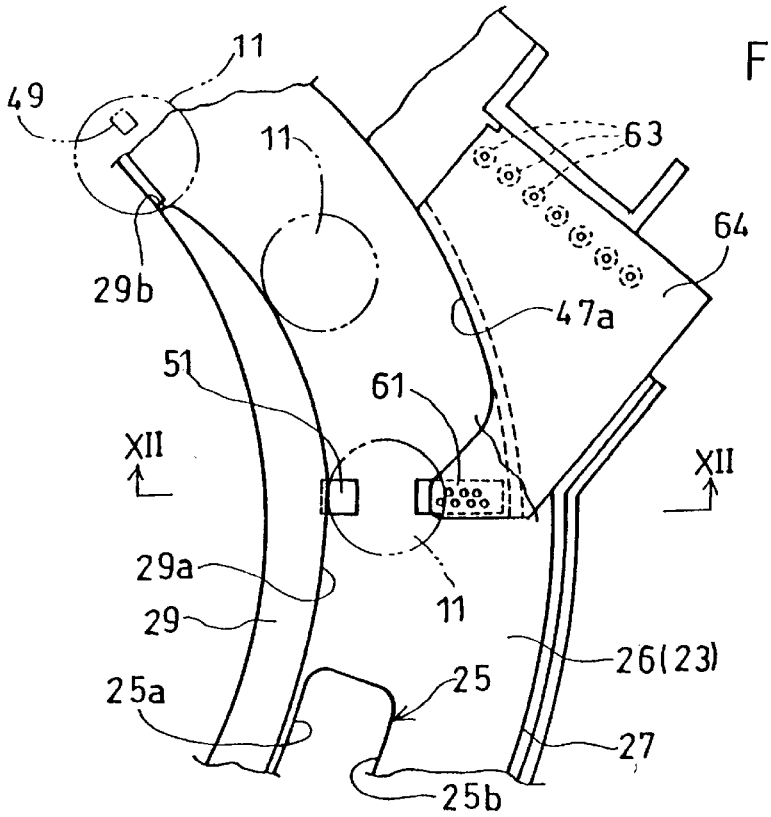
FIG. 11 is a plan view showing the token transfer inlet and the token discerner.

The outer circumferential wall 47 of the token transfer track 23 includes an introduction guide wall 47*a* extending between the transfer inlet 24 and the token discerner 31 (See FIGS. 5 and 11). Preferably, the distance between the introduction guide wall 47*a* and the outer edge 29*a* of the reference guide plate 29 gradually decreases toward the token discerner 31, and the distance is preferably equal to or slightly larger than the maximum diameter of the tokens 11 to be sorted. With this structure, even when the token 11 deviates radially outward of the transfer belt 11, the token 11 is guided along the introduction guide wall 47*a* to come close to the outer edge 29*a* of the reference guide plate 29. Therefore, erroneous determination of the diameter of the token 11 can be eliminated.

Although the fin 37 is flat and extends radially of the rotary ring 33 in the above-described embodiment, the fin may be a round bar or a square bar. Alternatively, a plurality of (two to four) ring-shaped fins each projecting downward and having a relatively small thickness in the radial direction may be arranged concentrically with the rotary disc.

The rotary ring 33 is provided with a downwardly projecting auxiliary elastic member 49 made of rubber for example for preventing stagnation of the tokens 11 at the token transfer inlet 24. In one embodiment, as shown in FIGS. 10(*a*), 10(*b*), 10(*c*) and 11, the auxiliary elastic member is so arranged as to pass radially inward of the transfer belt 30 but slightly radially outward of a tip end 29*b* of the reference guide plate 29 adjacent the token transfer inlet 24. Specifically, the rotary ring 33 is radially inwardly provided with a vertically penetrating fixing hole 50 into which the auxiliary elastic member 49 in the form of a bar made of rubber is inserted from below. The fixing hole 50 is upwardly provided with engagement projections 50*a*, 50*b* for preventing the upper portion of the auxiliary elastic member 49 from coming off.

Figure 12:
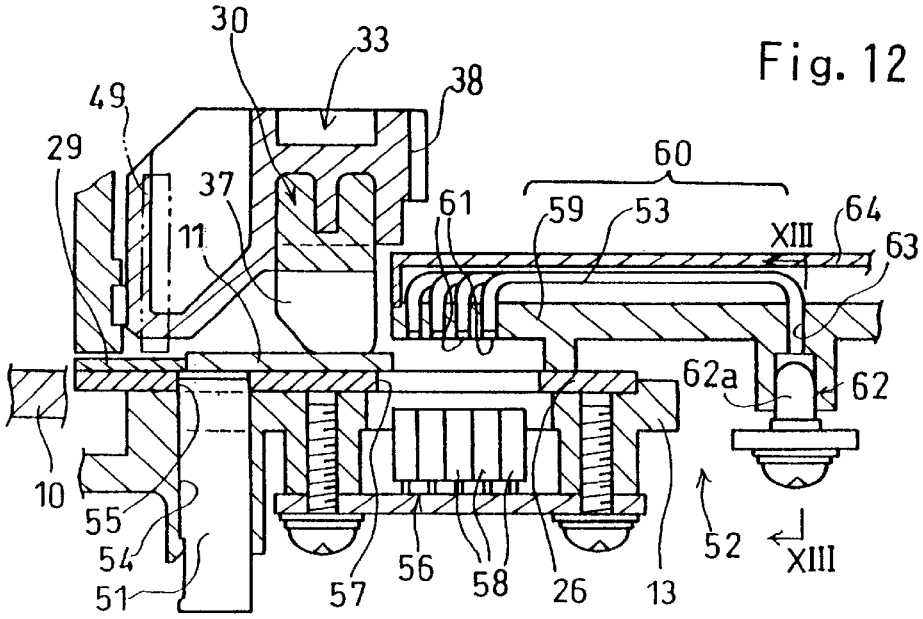
FIG. 12 is an enlarged sectional view taken on lines XII—XII in FIG. 11.
Figure 13:
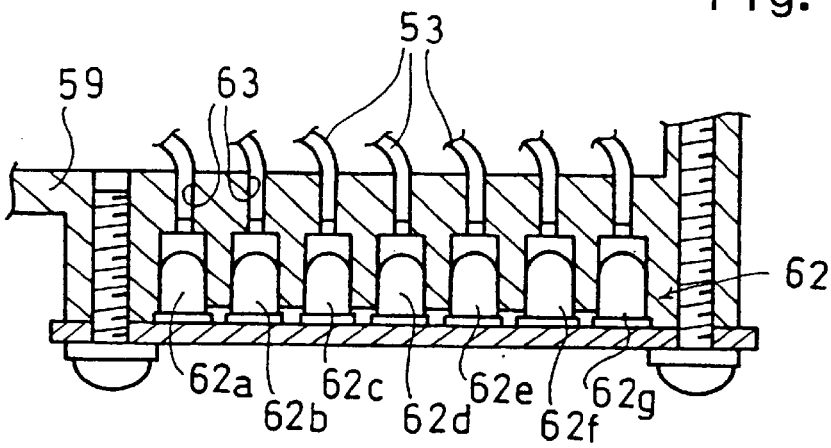
FIG. 13 is a sectional view taken on lines XII—XII in FIG. 12.

The lower end surface of the auxiliary elastic member 49 is held out of contact with the upper surface of the reference guide plate 29 having a thickness smaller than that of the tokens 11 (See FIG. 12). Further, the lower end surface of the auxiliary elastic member 49 moving together with the rotation of the rotary ring 33 comes into contact with the upper surface of the token 11 which has become radially unmovable neither outwardly nor inwardly as a result of hitting against the tip end 29*b* of the reference guide plate 29 and flicks the token 11 radially outwardly as much as possible. In this embodiment, two auxiliary resilient members are provided at opposite positions diametrically of the rotary ring 33 (generally 180° opposite positions).

The token discerner 31 is disposed in the token transfer track 23 between the token transfer inlet 24 and the sorting hole 25 at the most upstream position (the sorting hole 25 for the smallest token 11). The token discerner 31 includes a magnetic sensor 51 for detecting the number of transit tokens 11, and a photo sensor unit 52 provided with photo transmission cables 53 made of optical fibers for detecting the diameter of each token 11. The magnetic sensor 51 can detect tokens 11 made of metals such as copper, cupronickel, aluminum, nickel, steel for example. The magnetic sensor 51 is fixedly attached from below to a fixing hole 54 formed in the upper partition plate 13 of the lower casing at a position close to the outer edge 29*a* of the reference guide plate 29 in facing relationship to a hole 55 formed in the abrasion-resistant plate 26 (See FIG. 12).

The photo sensor unit 52 includes a light emitting portion 56 comprising light-emitting elements 58 such as light emitting diodes arranged below an elongated slot 57 extending in the abrasion-resistant plate 26 perpendicularly to the transfer direction of the tokens 11. The light-emitting elements are arranged generally in a row extending longitudinally of the slot 57 for emitting light upwardly. The photo sensor unit 52 further includes a light receiving portion 60 comprising a plurality (seven in this embodiment) of detection holes 61*a*–61*g* formed in a sensor casing 59 fixedly disposed in facing relationship to the slot 57 via the abrasion-resistant plate 26, and light receiving elements 62*a*–62*g* corresponding in number to the detection holes 61 and fixed to the sensor casing 59 as spaced from the detection holes 61, and the corresponding number of photo transmission cables 53 for connecting therebetween. Each of the photo transmission cables 53 has one end (light input end) fixedly inserted into a corresponding one of the detection holes 61*a*–61*g* and the other end (light output end) fixedly inserted into a corresponding one of holes 63 provided in facing relationship to the light receiving elements 62*a*–62*g*. The upper side of the sensor casing 59 is covered with a cover plate 64 so that unnecessary light from above (external portions) does not enter the photo transmission cables 53 and the holes 63.

Figure 15:
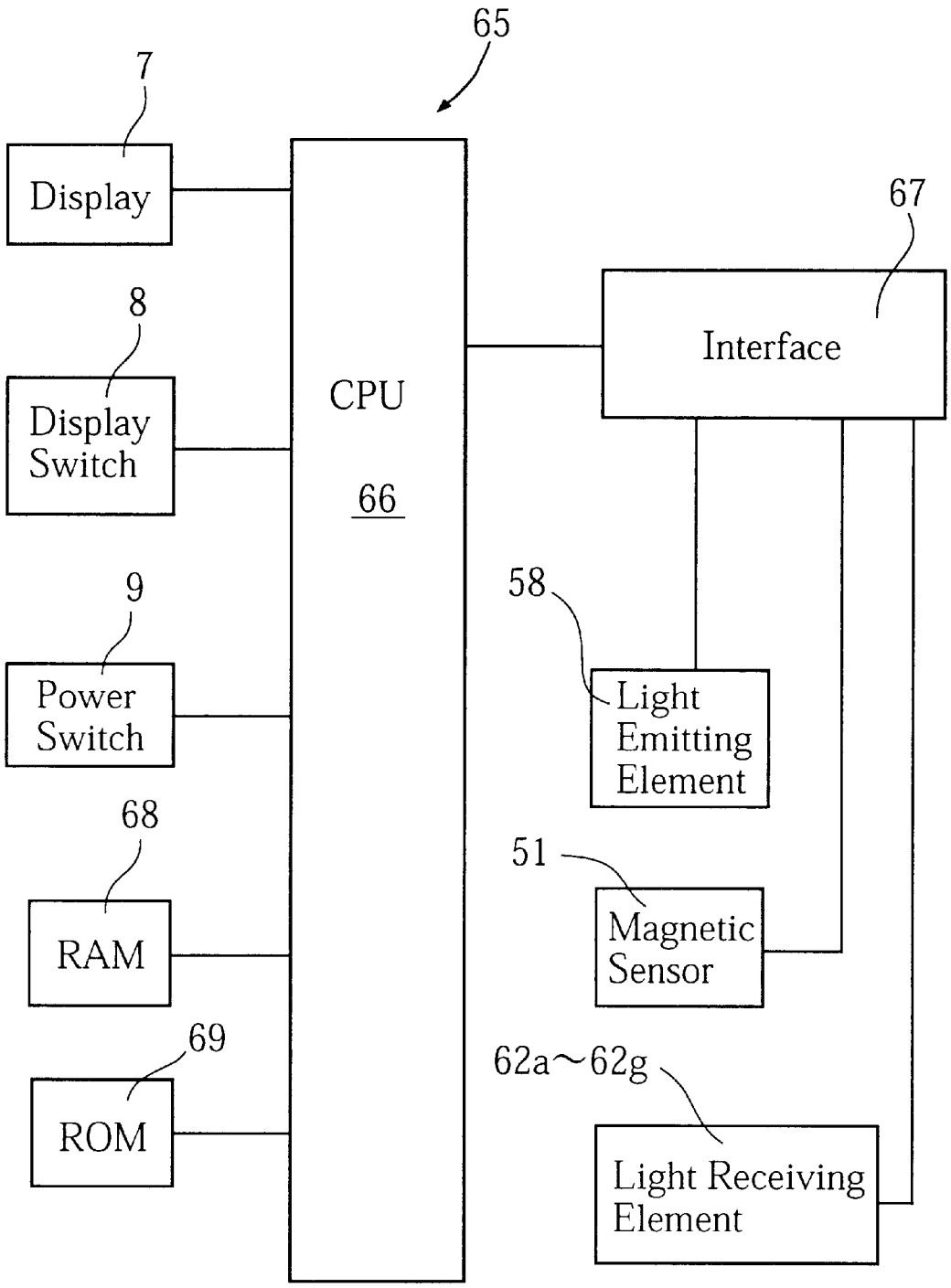
FIG. 15 is a block diagram of the controller.

When a token 11 made of a metal passes the magnetic sensor 51, a detection signal is outputted as a pulse (which is generally rectangular). Almost at the same time, a diameter-indicating signal is outputted as a pulse (which is also generally rectangular) as the token 11 having a predetermined diameter passes across the light receiving elements 62*a*–62*g*. These signals are inputted via an interface 67 to a CPU 66 as an electronic controlling unit 65 (See FIG. 15) such as a microcomputer. In the CPU 66, the count of tokens 11 for each kind and the total number of the tokens 11 are calculated. The results (the number and amount (sum) of the tokens 11 for each kind as well as the total number and amount (total sum) of the tokens) may be stored in a RAM (random-access memory) and can be numerically displayed on the display 7 by operating the display switches 8. The ROM (read-only memory) is provided to store a control program such as the control algorithm. The controller 65 may be accommodated at an appropriate position of the lower casing 2 or the upper casing 3.

Figure 14:
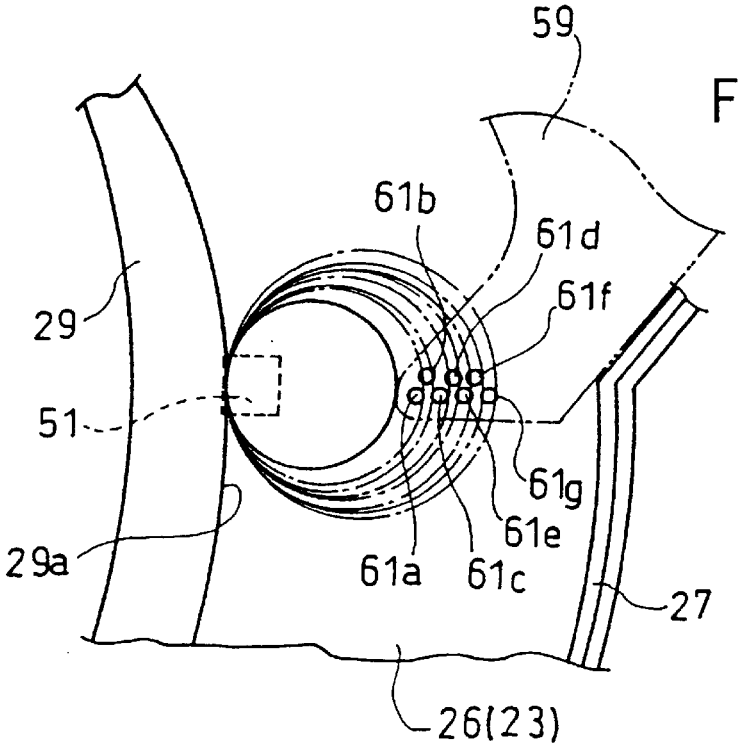
FIG. 14 is an enlarged plan view showing detection holes.

As shown in FIG. 14, the detection holes 61*a*–61*g* are so arranged as to discern the tokens of progressively increasing diameters. That is, when a token 11 passing is sensed (detected) only by the magnetic sensor 51, the token is determined to be 0.01 EURO coin which has the smallest diameter (=16.25 mm). When a token 11 passing is detected by the magnetic sensor 51 as well as by the detection hole 61*a*, the token 11 is determined to be 0.02 EURO coin (diameter: 18.75 mm) When a token 11 passing is detected by the magnetic sensor 51 as well as by the detection holes 61*a*, 61*b*, the token 11 is determined to be 0.10 EURO coin (diameter: 19.75 mm). Similarly, a token detected by the magnetic sensor 51 as well as the detection holes 61*a*, 61*b*, 61*c* is determined to be 0.05 EURO coin (diameter: 21.25 mm), a token detected by the magnetic sensor 51 as well as the detection holes 61*a*, 61*b*, 61*c*, 61*d* is determined to be 0.20 EURO coin (diameter: 22.25 mm), a token detected by the magnetic sensor 51 as well as the detection holes 61*a*, 61*b*, 61*c*, 61*d*, 61*e* is determined to be 1 EURO coin (diameter: 23.25 mm), a token detected by the magnetic sensor 51 as well as the detection holes 61*a*, 61*b*, 61*c*, 61*d*, 61*e*, 61*f* is determined to be 0.50 EURO coin (diameter: 24.25 mm), and a token detected by the magnetic sensor 51 as well as the detection holes 61*a*, 61*b*, 61*c*, 61*d*, 61*e*, 61*f*, 61*g* is determined to be 2 EURO coin (diameter: 25.75 mm).

For the tokens like monetary coins where tokens differ diametrically from one another stepwise by about 1.0–1.5 mm and where the manufacturing errors are very minor with respect to the diameter of each token, accurate stepwise discernment of tokens may be performed by employing detection holes 61 of a small diameter. Further, owing to the arrangement where the light receiving elements 62 are arranged as spaced from the detection holes 61 and connected to the detection holes by the photo transmission cables 53 for signal transmission, the necessity for using extremely small light receiving elements can be eliminated. (Although the transmission cable comprises one optical fiber having a diameter of 0.5 mm in this embodiment, the transmission cable may comprise a bundle of fibers of a smaller diameter.) Thus, the apparatus of the present invention can be manufactured from conventional parts so that the manufacturing cost can be prevented from increasing. For the light receiving element 62, use may be made of a photoconductive element, a photodiode, a phototransistor, a photo thyrister or the like.

Further, by incorporating the detection holes 61 and the light receiving elements 62 in the sensor casing 59, the manufacturing accuracy as well as the detection accuracy of the apparatus can be enhanced while realizing reduction of the manufacturing cost.

In another embodiment, for the photo sensor (light receiving element) for determining the diameter of a token, use may be made of a line-type imaging device (CCD) or a photoelectric conversion element such as a solar battery.

Instead of the magnetic sensor 51, a light-reflective sensor may be used for determining the number of the transit tokens 11.

The lower casing 2 is provided with an upwardly projecting lock segment 71 for engagement and disengagement relative to an engagement hole 72 formed at the front end of the upper casing 3. Thus, the upper and the lower casings 2, 3 can be kept closed (See FIGS. 1, 3 and 5).

Instead of manual rotation, the rotary disc 10 may be rotated by a driving motor.

Further, instead of each of the storage boxes 19, a hopper (not shown) may be releasably mounted to the lower casing 2 for communicating with a respective one of the sorting holes 25. A storage bag (not shown) for directly storing the sorted tokens may be releasably attached to the hopper.

What is claimed is:

1. An apparatus for counting and sorting different kind of tokens comprising:

a rotary disc having an upper surface for supporting the token, the disc being rotatable manually or by a driver;

a generally arcuate token transfer track extending along an outer circumference of the rotary disc for supporting a discal surface of each token, the transfer track including a token transfer inlet for receiving the tokens across the outer circumference for the rotary disc;

a plurality of sorting holes formed in the token transfer track or successively sorting and dropping the tokens in an order of increasing diameters as the tokens are transferred from an upstream side toward a downstream side in a transfer direction;

an annular transfer belt disposed above the outer circumference of the rotary disc for rotation together with the rotary disc to transfer the tokens with the discal surface of each token held pressed against a surface of the token transfer track;

a token discerner provided in the token transfer track between the token transfer inlet and the sorting hole located at the most upstream position in the transfer direction for counting the tokens while determining diameters of the tokens;

a controller for calculating results obtained by the token discerner;

a display for displaying the calculated results, which include the count of tokens for each kind and a total number of the tokens; and a reference guide plate having an outer circumferential edge that provides an inner circumferential wall of the token transfer track for contact with a circumferential edge of each transferred token, the reference guide plate being disposed outwardly from the outer circumference of the rotary disc;

wherein the reference guide plate is arranged so that the inner circumferential wall is close to the outer circumference of the rotary disc at a position adjacent the token transfer inlet and gradually deviates away from the outer circumference of the rotary disc while approaching an inner circumference of the transfer belt between the token transfer inlet and the token discerner as the inner circumferential wall extends downstream in the transfer direction;

wherein the transfer belt has a lower surface formed with a multiplicity of projecting fins that are arranged at a predetermined pitch and are elastically deformable for pressing the tokens toward an upper surface of the token transfer track, the fins forcing the circumferential edge of each transferred token into contact with the outer circumferential edge of the reference guide plate at a portion downstream from the token discerner.

2. The token counting and sorting apparatus according to claim 1, further comprising an auxiliary elastic member projecting downward between the outer circumference of the rotary disc and the inner circumference of the transfer belt for rotating together with the transfer belt for preventing stagnation of the tokens at a portion adjacent the token transfer inlet.

3. The token counting and sorting apparatus according to claim 1, wherein the rotary disc and the token transfer track are provided in a lower casing the transfer belt being mounted to a rotary ring that is rotatably mounted to an upper casing capable of opening and closing movement relative to the lower casing, the upper casing being provided with a token feed opening radially inward from the rotary ring for feeding the tokens toward the rotary disc, the rotary ring being provided with a power transmission unit driven for rotation by a driving mechanism of the lower casing.

4. The token counting and sorting apparatus according to claim 1, wherein the lower surface of the transfer belt is formed with a multiplicity of projecting fins, each of which is inclined toward the upstream side in the transfer direction as the fin extends downward.

5. The token counting and sorting apparatus according to claim 1, wherein the token discerner comprises detection holes respectively arranged at positions for determining the diameters of the tokens, and photo sensors disposed separately from the detection holes and connected thereto via photo transmission cables.

6. The token counting and sorting apparatus according to claim 1, further comprising a storage box or a hopper releasably mounted below each of the sorting holes for collecting and storing the tokens sorted, the hopper being provided with a storage bag removably attached thereto.

7. The token counting and sorting apparatus according to claim 1, wherein the transfer belt is disposed above the token transfer track, the transfer belt being arranged to be close to an outer circumferential wall of the token transfer track at a portion adjacent the token transfer inlet and gradually approach the reference guide plate as the transfer belt extends downstream in the transfer direction.

* * * * *